United States Patent [19]

Rodert

[11] Patent Number: 5,005,656

[45] Date of Patent: Apr. 9, 1991

[54] DEVICE IN IMPACT MACHINES

[75] Inventor: Jörgen A. R. Rodert, Saltsjö-Boo, Sweden

[73] Assignee: Atlas Copco MCT AB, Nacka, Sweden

[21] Appl. No.: 476,989

[22] Filed: Feb. 8, 1990

[30] Foreign Application Priority Data

Mar. 7, 1989 [SE] Sweden ..... 8900783

[51] Int. Cl.[5] ..... E21B 4/00

[52] U.S. Cl. ..... 175/306; 175/417

[58] Field of Search ..... 166/296, 305, 306, 320, 166/417

[56] References Cited

U.S. PATENT DOCUMENTS 3,227,230 1/1966 Lagerström ..... 175/306 X

*Primary Examiner*—William P. Neuder

*Attorney, Agent, or Firm*—Eric Y. Munson; Mark P. Stone

[57] ABSTRACT

Device in impact machines. The device comprises a number of rods (6) provided with projections (51). The rods are journalled in a surrounding set of tubes (7) by means of elastic bushings (52,53) which are provided with grooves (57) through which said projections can be passed.

1 Claim, 2 Drawing Sheets

DEVICE IN IMPACT MACHINES

BACKGROUND OF THE INVENTION

The present invention relates to a device in impact machines for drilling, preferably in rock, by means of a drill string comprising a set of tubes and a set of rods arranged in the set of tubes.

When drilling with a tool of the above mentioned kind the problem arises of holding the central rods in place in the surrounding tubes in a simple way so that tubes with rods can be transported at the work place without the rods falling out. According to a prior art solution a guide is mounted at one end of the tube. The rod is then inserted from the other end. Then a second guide is mounted about the other end of the rod and is locked by a lock ring.

SUMMARY OF THE INVENTION

The present invention, aims at achieving a device in impact machines of the type discussed above in which both guides are mounted first and the rod is then inserted, and the lock ring can be avoided.

BRIEF DESCRIPTION OF THE DRAWINGS

An embodiment of the invention is described below with reference to the accompanying drawings where FIG. 1 schematically shows a section through the rear part of a device according to the invention.

DESCRIPTION OF THE PREFERRED EMBODIMENTS OF THE INVENTION

Figure 1:
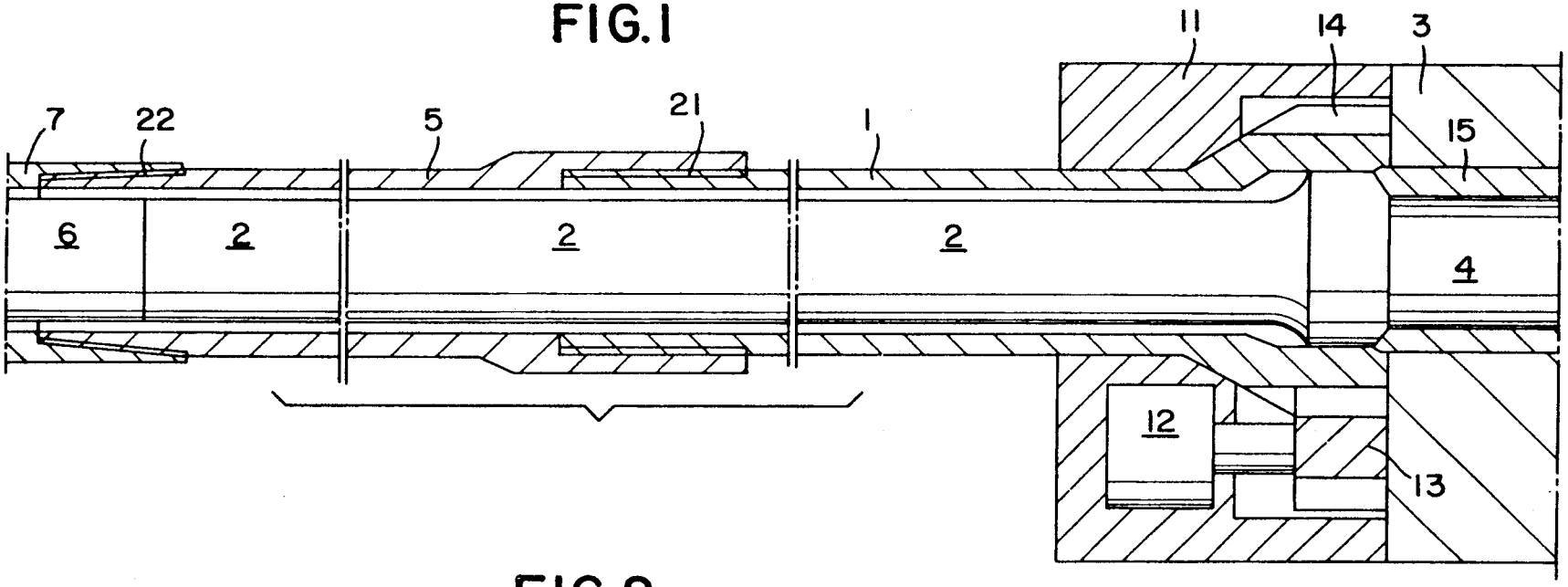
Figure 2:
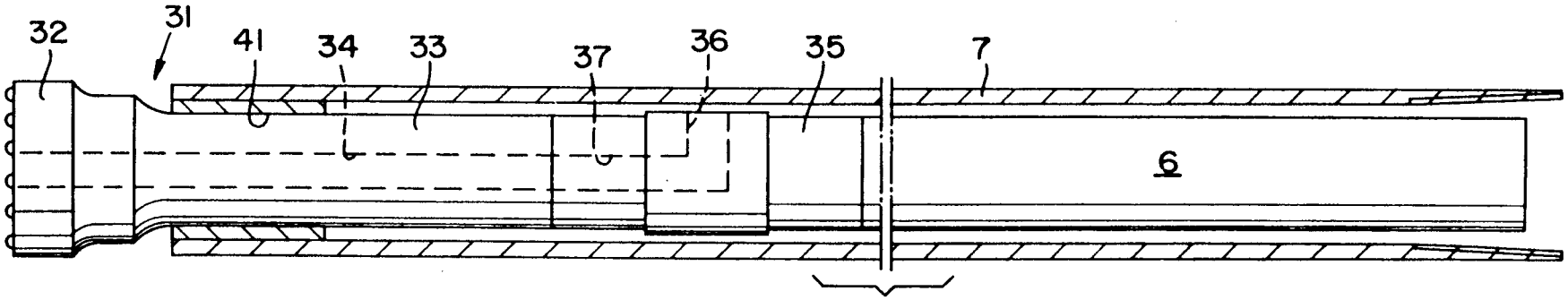
FIG 2 shows a section through the front part of the device according to FIG. 1.

The device shown in the drawings comprises a machine housing 3 in which a hammer piston 4 is movable to-and-fro to impact a drill tool. The hammer piston is guided in a sleeve 15. The machine housing comprises a front part 11 in which a drill sleeve 1 is rotatably arranged. The drill sleeve is rotated by a rotary device comprising a rotation motor 12 with a gear 13 which gears with teeth 14 on the drill sleeve. The drill sleeve 1, which extends out of the machine housing, is at its front end provided with a thread 21 by means of which the drill sleeve is connectable with a tube 5 which forms an extension of drill sleeve 1. Tube 5 is by means of a threaded connection 22 connected with a set of tubes 7. The set of tubes comprises a number of tubes which are connected with each other by means of threaded connections 22. A drill bit 31 is by means of a splined coupling 41 connected to the front end of the set of tubes. A rod 2 is glidably arranged in drill sleeve 1 to transfer the impact energy of hammer piston 4 to a set of rods 6 which is axially movable in the set of tubes 7. The set of rods comprises a number of drill rods which rest loosely against each other. The set of rods transfers the energy of the hammer piston, via a rod 35 arranged adjacent to the drill bit, to the drill bit. Drill bit 31 comprises a work part 32 and a shaft 33. Drill bit 31 is provided with a flushing channel 34 which in shaft 33 has axial extension only. Rod 35 arranged adjacent to the drill bit comprises an axial flow channel 37 connecting to flushing channel 34 in drill bit 31. A channel 36 connects the envelope surface of the rod with flow channel 37. During drilling flushing medium is supplied in a not shown way to the space between the set of rods 6 and the set of tubes 7. The flushing medium is from there conducted through channel 36, flow channel 37 and flushing channel 34 to the drill area for flushing away drill cuttings. The rods in the set of rods are provided with projections 51 to prevent the rods from falling out from the set of tubes. The length of drill bit 31 should be relatively short in order to be inexpensive to manufacture. Since it should be well guided by the set of tubes 7 it should not be too short. It has turned out that the length of the drill bit should be less than 80%, preferably less than 70%, of the length of the hammer piston. The sum of the length of drill bit 31 and the adjacent rod 35 should be substantially equal to the length of hammer piston 4. The rods between rod 35 and hammer piston 4 can be of arbitrary length without prejudice to the transfer of impact energy from the hammer piston to the drill bit.

Figure 3:
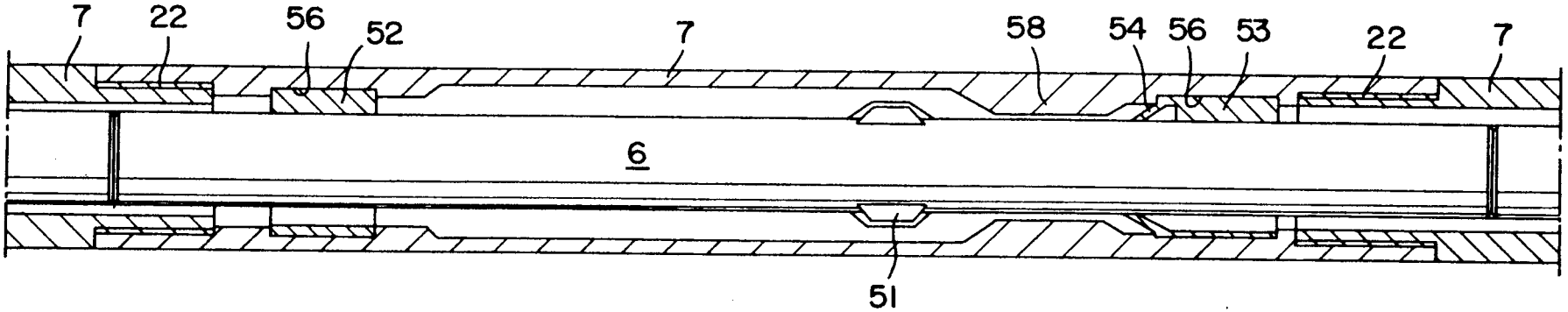
FIG 3 shows a part of the device more in detail
Figure 4:
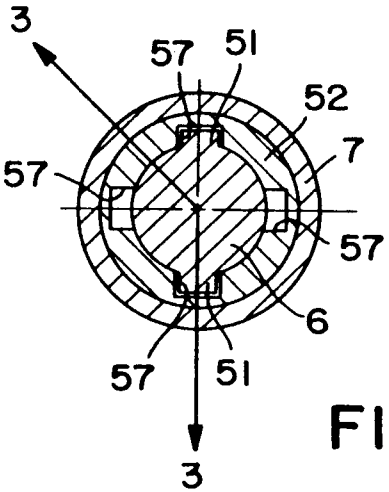
FIG. 4 shows a section through the device according to FIG. 3 in a specific phase of the mounting of a central rod.

In FIGS. 3 and 4 it is shown how rods 6 are stored in tubes 7. Projections 51 work together with part 58 on the tubes as axial stop for the rods 6. In practical work one normally has two tubes with rods in as tool unit. The tubes are then mirror-inverted relative to each other so that parts 58 are situated at the ends being most distant from each other. Tubes 7 are provided with grooves 56 in which elastic bushings 52,53 are axially fixed. As is shown in FIG. 4 the bushings are provided with a number of grooves 57 through which the projections 51 can be moved. FIG. 4 shows a rod and a bushing when the projections are moved through. Grooves 57 also serve as flushing medium channels. In the shown example bushing 53 is provided with a lip 54 the purpose of which is to prevent flushing liquid from passing towards the right in the figure in connection with the adding of rods at upwards drilling. At upwards drilling of long holes large amounts of flushing liquid can be present between the set of rods and the set of tubes. Lip 54 is in practice provided with a number of longitudinal cuts so that the lip easily opens when flushing liquid is pumped forward and easily closes when the flushing liquid pressure is released. When the drill tool is mounted bushings 52,53 are first put in place. This is done by squeezing the bushings which are made of a plastic material, e.g. polyurethane, and inserting them in tube 7. Then the bushings are allowed to expand in groove 56. Rod 6 is entered from the left in the figure, whereby the projections are moved through grooves 57 in bushing 52. Then the rod is entered through bushing 53. The such mounted tool part is then screwed together with another equally mounted but mirror-inverted tool part, after which the two rods are axially blocked in the two tubes screwed together. This unit can now be transported at the work place without risk that the rods fall out.

Figure 5:
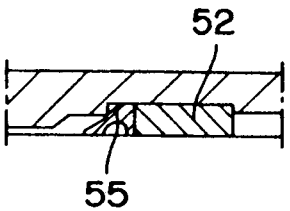
FIG. 5 shows an alternative embodiment of one of the guides.

In the alternative embodiment according to FIG. 5 the lip seal 55 is made as a separate unit resting against bushing 52.

I claim:

1. Device in impact machines comprising a maching housing (3, 11), a hammer piston (4) movable to-and-fro in the machine housing and arranged to deliver impacts against a tool, and a rotary device (12, 13) for rotation of the tool, said tool comprising a central set of rods comprising a plurality of rods (6) and a set of tubes comprising a plurality of interconnected tubes (7) surrounding the set of rods, said rods (6) being provided with projections (51), characterized in that said plurality of rods rest loosely against each other, each of said plurality of rods being provided with at least one of said projections (51), each of said plurality of said rods (6) being guided by elastic bushings (52, 53) arranged in said tubes (7), and said elastic bushings comprising a plurality of grooves (57) through which said projections (51) can be passed.

* * * * *